US006817915B2

(12) United States Patent
Kyogaku et al.

(10) Patent No.: US 6,817,915 B2
(45) Date of Patent: Nov. 16, 2004

(54) METHOD OF TRANSFORMING POLYMER FILMS INTO CARBON FILMS

(75) Inventors: Masafumi Kyogaku, Kanagawa (JP); Hironobu Mizuno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/351,343

(22) Filed: Jan. 27, 2003

(65) Prior Publication Data

US 2003/0162464 A1 Aug. 28, 2003

(30) Foreign Application Priority Data

Feb. 28, 2002 (JP) ..... 2002/054169

(51) Int. Cl.[7] ..... H01J 31/00

(52) U.S. Cl. ..... 445/24; 445/50; 445/51; 445/13

(58) Field of Search ..... 445/24, 25, 50, 445/51, 13

(56) References Cited

U.S. PATENT DOCUMENTS

| | | | | |
|---|---|---|---|---|
| 6,123,876 | A | 9/2000 | Kobayashi et al. | 252/519.2 |
| 6,179,678 | B1 | 1/2001 | Kishi et al. | 445/24 |
| 6,221,426 | B1 | 4/2001 | Yamanobe | 427/77 |
| 6,334,803 | B1 | 1/2002 | Shibata | 445/51 |
| 6,383,047 | B1 | 5/2002 | Minami et al. | 445/6 |
| 2002/0081931 | A1 | 6/2002 | Iwaki et al. | 445/6 |
| 2002/0117670 | A1 | 8/2002 | Horiguchi et al. | 257/59 |
| 2003/0039767 | A1 | 2/2003 | Mizuno et al. | 427/595 |
| 2003/0073371 | A1 | 4/2003 | Iwaki | 445/24 |
| 2003/0160180 | A1 | 8/2003 | Arai et al. | 250/424 |
| 2003/0161942 | A1 | 8/2003 | Arai et al. | 427/77 |
| 2003/0162465 | A1 | 8/2003 | Mizuno et al. | 445/24 |
| 2003/0162467 | A1 | 8/2003 | Shimazu et al. | 445/50 |

FOREIGN PATENT DOCUMENTS

| | | | |
|---|---|---|---|
| EP | 0 736 890 A1 | 10/1996 | H01J/1/30 |
| EP | 0 788 130 A2 | 8/1997 | H01J/9/02 |
| EP | 0 803 890 A1 | 10/1997 | H01J/9/02 |
| EP | 1 184 886 A1 | 3/2002 | H01J/9/02 |
| JP | 07-065704 | 3/1995 | H01J/1/30 |
| JP | 08-055563 | 2/1996 | H01J/1/30 |
| JP | 08-321254 | 12/1996 | H01J/1/30 |
| JP | 09-161666 | 6/1997 | H01J/9/02 |
| JP | 09-237571 | 9/1997 | H01J/9/02 |
| JP | 11-120901 | 4/1999 | |

OTHER PUBLICATIONS

Baba et al., "Field Emission from an Ion–Beam–Modified Polyimide Film," Jpn. J. Appl. Phys., V. 38, pp. L261–L263 (1999).

*Primary Examiner*—Vip Patel
*Assistant Examiner*—Sharlene Leurig
(74) *Attorney, Agent, or Firm*—Fitzpatrick, Cella, Harper & Scinto

(57) ABSTRACT

A process of efficiently transforming polymer films arranged on an electron source substrate into carbon films is provided. A light is irradiated onto a region of the substrate where a plurality of polymer films, associated electrodes and part of wirings are arranged so that the plurality of polymer films are simultaneously transformed into lower resistance films such as carbon films through heating by the irradiated light, wherein for the irradiating light, a light absorptance of the wirings is lower than that of the electrodes.

6 Claims, 15 Drawing Sheets

METHOD OF TRANSFORMING POLYMER FILMS INTO CARBON FILMS

BACKGROUND OF THE INVENTION

1. Field of the Invention

The present invention relates to a method of manufacturing an electron source including a large number of electron-emitting devices.

2. Related Background Art

Up to now, a surface conduction electron-emitting device has been known as an electron-emitting device. The surface conduction electron-emitting device utilizes a phenomenon that electron emission is developed by allowing a current to flow in a thin film of a small area, which is formed on a substrate, in parallel with the film surface. A structure of such a surface conduction electron-emitting device and a method of manufacturing such a device are disclosed, for example, in Japanese Patent Application Laid-Open No. 8-321254.

FIGS. 18A and 18B schematically shows the general construction of a surface conduction electron-emitting device disclosed in the above publication or the like. FIGS. 18A and 18B are a plan view and a sectional side view of the electron-emitting device, respectively. In FIGS. 18A and 18B, reference numeral 1701 denotes a substrate, 1702 and 1703 denote a pair of electrodes facing each other, 1704 denotes an electroconductive film, 1705 denotes a second gap, 1706 denotes a carbon film, and 1707 denotes a first gap.

FIGS. 17A to 17D schematically shows an example of a manufacturing process for forming an electron-emitting device having the structure shown in FIGS. 18A and 18B.

The pair of electrodes 1702 and 1703 are first formed on the substrate 1701 (FIG. 17A), followed by forming the electroconductive film 1704 for connecting between the electrodes 1702 and 1703 (FIG. 17B).

Then, an electric current is fed between the electrodes 1702 and 1703 and the so-called "forming step" is performed for forming the second gap 1705 in a part of the electroconductive film 1704 (FIG. 17C).

Subsequently, in a carbon compound atmosphere, a voltage is applied between the electrodes 1702 and 1703 to perform the so-called "activation step" by which the carbon film 1706 is formed on a part of the substrate 1701 within the area of the second gap 1705 and is also formed on a part of the electroconductive film 1704 in the vicinity of the second gap 1705, resulting in an electron-emitting device (FIG. 17D). Note that, in the "activation step", a pulse voltage is repeatedly applied between the device electrodes 1702 and 1703 in an atmosphere containing an organic substance, whereby carbon and/or carbon compound is deposited on a device.

On the other hand, Japanese Patent Laid-Open No. 9-237571 discloses another method of manufacturing a surface conduction electron-emitting device. The method comprises a step of coating an organic material film such as a thermosetting resin, or the like on an electroconductive film and a step of carbonizing the coating, instead of the above-described "activation step".

When an electron source including a plurality of the above-described electron-emitting devices is used, an image display apparatus can be structured by combining the electron source and an image-forming member comprised of a phosphor or the like.

SUMMARY OF THE INVENTION

An electron source using conventional surface conduction electron-emitting devices roughly has the following two problems.

1) It is not necessarily easy to form a conductive film with a high accuracy in the films thickness and quality, thereby deteriorating uniformity in forming many electron-emitting devices in a flat panel display.

2) In order to form a narrow gap having good electron emission performance, many additional steps such as a step of forming an atmosphere containing an organic material, a step of precisely forming a polymer film on an electroconductive film, etc., thereby complicating control of each of the steps.

For solving the above problems, an object of the present invention is to provide a stable manufacturing method of an electron source and to provide a method of manufacturing an image-forming apparatus with no deficit and with excellent display quality at low cost.

The present invention has been made as a result of extensive studies for solving the above-mentioned problems and provides the manufacturing method described below.

That is, according to the present invention, there is provided a method of manufacturing an electron source comprising the steps of: (A) providing a substrate on which a plurality of units and wirings are arranged, each unit comprising a pair of electrodes and a polymer film for connecting the electrodes of the pair and the wirings respectively being connected to at least one of the plurality of units; (B) irradiating light onto a region of the substrate where two or more units and part of the wirings are arranged, to reduce resistivity of the polymer film in each of the two or more units; and (C) forming a gap in a film obtained by performing the step (B), wherein, at the irradiating light in step (B), a light absorptance of the wirings is lower than that of the electrodes.

The manufacturing method according to the present invention includes, as preferred aspects, "the irradiation of light is performed to all the plurality of units with sequential scanning", "the light absorptance of the wirings is lower than a light absorptance of the pair of electrodes by 15% or more", "a light absorptance of the wirings is 20% or less", and the method further includes the step of arranging a coating layer on a base layer of the wirings, for the irradiation light in the step (B), a reflectivity of the coating layer being higher than that of the base layer. In one embodiment, the gap is formed by flowing an electric current through a film obtained by the step (B).

According to the method of manufacturing an electron source of the present invention, the electrode has a relatively high light absorptance or a relatively low light reflectance at the irradiating light wavelength. Thus, light is absorbed to the electrode to cause a temperature rise efficiently, and further, the temperature of the polymer film rises due to thermal conduction to thereby promote resistance reduction. On the other hand, the wiring connected to the electrode has a relatively low light absorptance or a relatively high light reflectance. Thus, most of the light irradiated to the wiring is reflected, and the temperature rise of the wiring can be suppressed.

Note that the wavelength range, intensity, and irradiation time of the light to be irradiated are adjusted such that: the temperature rise of the wiring stops at a temperature less than a heat-resistance temperature (melting point or softening point) of the wiring; and the temperature of the electrode rises efficiently, and the temperature rise of the polymer film due to thermal conduction from the electrode to the polymer film and the light absorption of the polymer film itself transforms the polymer film to attain sufficient resistance reduction.

As a result, the image display apparatus with no deficit of a display pixel can be obtained in which the wirings are not subjected to short circuit or breaking.

DESCRIPTION OF THE PREFERRED EMBODIMENTS

Hereinafter, description will be made of embodiments of the present invention with reference to the drawings. However, the present invention is not limited to these embodiments.

Figure 1:
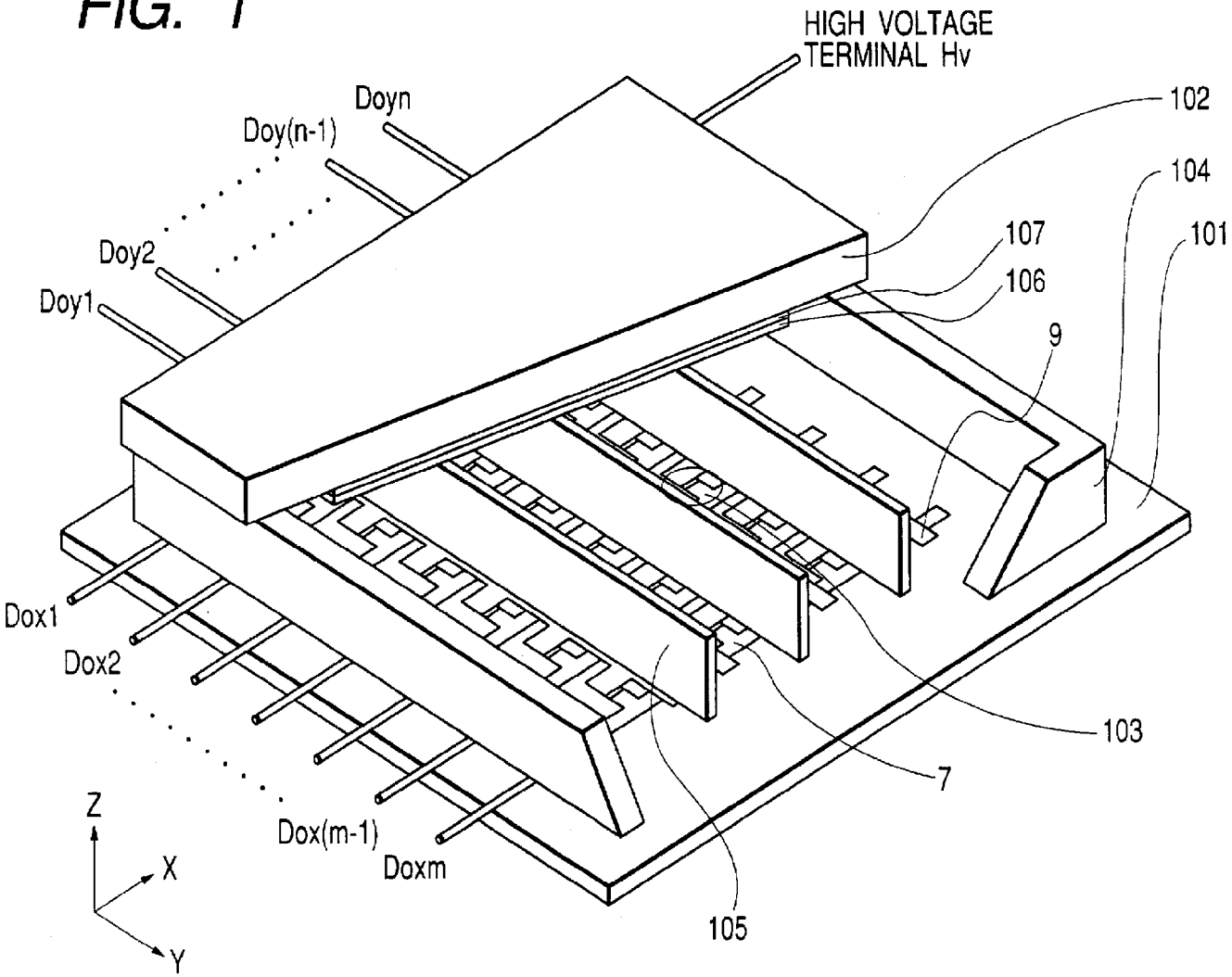
FIG. 1 is a schematic diagram illustrating an example of a display panel of an image display apparatus in a passive matrix arrangement according to the present invention.

FIG. 1 is a schematic diagram showing an example of an image-forming apparatus using an electron source 103 manufactured by a manufacturing method according to the present invention. Further, FIG. 1 is a diagram in which a part of a supporting frame 104 and a part of a face plate 102, which will be described below, are removed for illustrating the inside of the image-forming apparatus (an airtight container).

In FIG. 1, reference numeral 101 denotes a rear plate provided with the electron source 103. On the face plate 102, image forming members (106 and 107) are arranged. The supporting frame 104 is provided for retaining a space between the face plate 102 and the rear plate 101 under a reduced pressure. Denoted by 105 is a spacer for retaining an interval between the face plate 102 and the rear plate 101.

If the image-forming apparatus is a display, the image forming members comprises a phosphor film 107 and an electroconductive film such as a metal back 106. Reference numerals 7 and 9 denote wirings connected for applying voltages to respective electron-emitting devices 103, respectively. In the figure, symbols Doy1 to Doyn and Dox1 to Doxm denote output wirings for connecting between a drive circuit or the like arranged outside the image-forming apparatus and the ends of the wirings 7 and 9 guided from a decompressed space (a space surrounded by the face plate 102, the rear plate 101, and the supporting frame 104) of the image-forming apparatus to the outside.

Figure 2A:
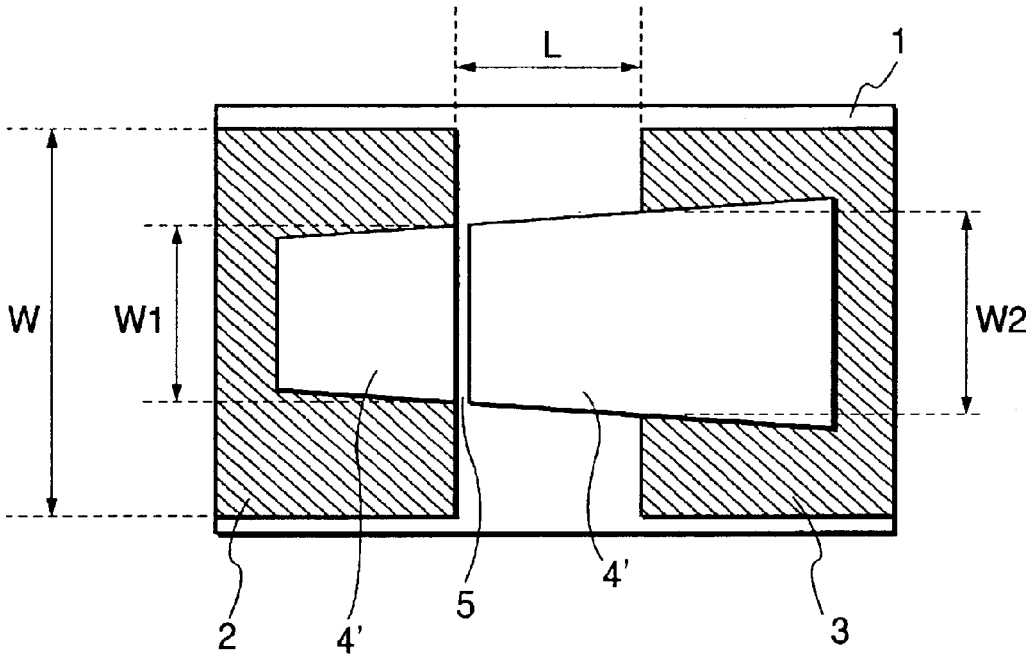
FIGS. 2A and 2B are schematic diagrams illustrating an example of an electron source according to the present invention.
Figure 2B:
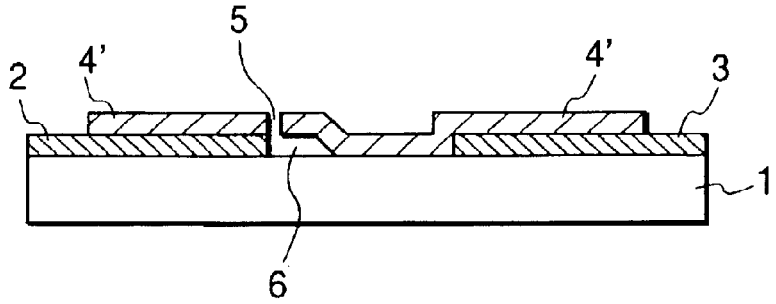

Referring now to FIGS. 2A and 2B, the electron-emitting device 103 (shown in FIG. 1) is illustrated in more detail. Here, FIGS. 2A and 2B are schematic diagrams showing a structural example of the electron-emitting device. FIG. 2A is a plan view and FIG. 2B is a sectional view on the assumption that the plane is substantially vertical to a surface of a substrate 1 on which electrodes 2 and 3 are arranged while passing therebetween.

In FIGS. 2A and 2B, the substrate 1 and the electrodes 2 and 3 are shown. In addition, denoted by 4' is a film obtained by subjecting a polymer film to resistance reducing process (and to "voltage application step" as described below). Reference numeral 5 denotes a gap, and 6 denotes an air gap between the substrate 1 and the film 4' obtained by subjecting a polymer film to resistance reduction, which constitutes a part of the gap 5. As shown in FIG. 2B, for example, the surface of the electrode 2 is exposed (exists) at least in the part inside the gap 5. Note that, to be exact in explanation, the film 4' shown in FIGS. 2A and 2B refers to a film obtained by subjecting a polymer film to a "resistance reducing process" and a "voltage application step" although detailed description thereof will be made below.

In the electron-emitting device thus structured, when electric field is applied to the gap 5 sufficiently, electrons tunnel through the gap 5 to cause current to flow between the electrodes 2 and 3. Part of the tunnel electrons becomes emitted electrons (for example, by means of scattering).

Next, description will be made of an example of a method of manufacturing an electron-emitting source of the present invention with reference to FIGS. 2A and 2B.

(1) A base plate (substrate) 1 made of glass or the like is sufficiently washed with detergent, pure water, organic solvent, and so on. Then, an electrode material is deposited thereon by a vacuum deposition method, a sputtering method, or the like, followed by forming the electrodes 2 and 3 on the substrate 1 using, for example, a photolithography technique. Preferably, as a material for the substrate 1, a transparent substrate made of glass etc. is used. However, basically, there arises no problem as long as the substrate is an insulating substrate. In the present invention, it is particularly preferable to use a glass substrate.

Further, in particular, as materials for the electrodes 2 and 3 with the gap 5 shown in FIGS. 2A and 2B disposed in the vicinity thereof, a material is used which has characteristics of efficiently absorbing light to raise a temperature in the "resistance reducing process step" as will be described later and which is high in melting point and different from the film 4' that have undergone the "voltage application step" for forming the gap 5 described below.

Specifically, used is a material having a melting point of 800° C. or more corresponding to a temperature at which the polymer film transforms and preferably having a light absorptance of 25% or more or light reflectance of 75% or less with respect to a wavelength of used light although absorbing and reflecting characteristics with respect to light vary depending on the wavelength of used light. Also, in order to efficiently raise a temperature, a material having low thermal conductivity is preferably used.

A metallic material can be used as a material satisfying such conditions. When visible radiation is used, metallic materials such as Pt, Pd, Fe, Ni, W, Ti, and Mo can be used as well as metallic materials such as Al.

Also, the materials for the electrodes 2 and 3 may be different from each other as long as they satisfy the conditions required for the electrode materials.

Note that, an interval L between the electrodes 2 and 3 is preferably set to 1 $\mu$m or more and 100 $\mu$m or less.

(2) A polymer film is formed on the substrate 1 on which the electrodes 2 and 3 are arranged to make a connection between these electrodes 2 and 3.

The term "polymer" in the present invention refers to one having at least a bond between carbon atoms. Also, the molecular weight of the polymer in the present invention is 5,000 or more, and preferably 10,000 or more. When heat is applied to the polymer having the bonds between carbon atoms, they may dissociate and recombine to thereby increase conductivity in some cases. As described above, the polymer whose conductivity is increased as a result of application of heat is called a "pyrolytic polymer".

There is a case where the polymer obtains increased conductivity by dissociating and recombining the bonds between carbon atoms, which includes dissociation and recombination caused due to factors other than heat, for example, photon, together with dissociation and recombination due to heat. In the present invention, the polymer in this case is also referred to as pyrolytic polymer.

However, in the present invention, structural changes and changes in conductive characteristics of the polymer, which are caused due to heat or the factors other than heat are collectively referred to as "transformation".

The pyrolytic polymer may be considered to increase conductivity by increasing conjugated double bonds between carbon atoms in the polymer. The conductivity varies depending on a degree at which transformation proceeds.

As a polymer easily increasing conductivity due to dissociation and recombination of the bonds between carbon atoms, that is, a polymer easily generating therein the double bonds between carbon atoms, aromatic polymers may be given as an example. Thus, in the present invention, it is preferable to use the aromatic polymers. Among those, in particular, aromatic polyimide is a polymer capable of obtaining the pyrolytic polymer of high conductivity at a relatively low temperature. Therefore, it can be used as a more preferable material in the present invention.

In general, the aromatic polyimide is an insulator in itself but there are polymers such as polyphenylene oxadiazole and polyphenylene vinylene, which obtain conductivity before performing thermal decomposition. These polymers also express conductivity further due to thermal decomposition and thus are preferably used in the present invention.

A method of forming the polymer film may include various methods well-known in the art, i.e., a spin coating method, a printing method, a dipping method, and so on. In particular, the polymer film can be formed at low cost by the printing method. Thus, it is a preferable technique. Among those, the printing method of ink jet system is used, so that it is possible to dispense with a patterning step and to form a pattern of several hundreds of $\mu$m or less as well. Thus, it is also effective for manufacturing such an electron source as to be applied to a flat panel display and to have electron-emitting devices disposed therein at high density.

When the polymer film is formed according to the ink jet system, a solution containing a polymer material may be ejected and applied on to the substrate and dried. As needed, however, it is also possible that a precursor solution of a desired polymer is ejected and applied on to the substrate to be turned into a polymer by heating or the like.

According to the present invention, the aromatic polymers are preferably used as the polymer material. However, most of them is almost insoluble in a solvent, so that a technique of applying the precursor solution thereof is effective. As an example thereof, a polyamic acid solution as a precursor of aromatic polyimide is applied thereto to form a polyimide film by heating or the like.

Note that, for example, a solvent for solving the polymer precursor may be selected from the group consisting of N-methyl-pyrrolidone, N,N-dimethyl acetamide, N,N-dimethyl formamide, dimethyl sulfoxide, and so on. In addition, n-butyl cellosolve, triethanolamine, or the like may be additionally used in combination with such a solvent. However, it is not particularly limited to a specific one as long as the present invention is applicable thereto and the solvent is not limited to one of those listed above. According to the above steps, a unit comprises a pair of electrodes and a polymer film for connecting between the electrodes is formed.

(3) Subsequently, a "resistance reducing process" (or "resistance decreasing process) is performed so as to reduce resistivity of the polymer film. The "resistance reducing process" allows the polymer film to increase the conductivity and transforms the polymer film into the electroconductive film (film obtained by reducing resistivity of the polymer film) 4' with a desired resistivity value. Note that, the electroconductive film 4' formed by the "resistance reducing process" may be also called an "electroconductive film mainly containing carbon" or simply called a "carbon film".

In this step, from the viewpoint of the subsequent step of forming the gap 5, the "resistance reducing process" is performed until the polymer film is converted into the electroconductive film 4' with the sheet resistance within the range between $10^3$ Ω/□ or more and $10^7$ Ω/□ or less.

An example of this "resistance reducing process" is to reduce the resistivity of the polymer film by the application of heat thereto. As the reason why the resistivity of the polymer film is reduced (i.e., the film is turned conductive) by heating, the conductivity of the film is increased by dissociating and recombining the bonds between carbon atoms in the polymer film. The "resistance reducing process" by heating can be attained by heating the polymer constituting the polymer film at a temperature equal to or more than the decomposition temperature. In addition, the "resistance reducing process" is preferably performed in an anti-oxidizing atmosphere, for example, in an inert gas atmosphere or in a vacuum. The aromatic polymer described above, especially aromatic polyimide, has a high heat decomposition temperature, so that it may express a high conductivity when it is heated at a temperature above the heat decomposition temperature, typically a temperature in the range of 700° C. or more.

However, when the polymer film as a component member of the electron emitting device is heated until it is thermally decomposed, the method of heating the whole of the substrate 1 by using an oven, a hot plate, or the like is possibly restricted from the viewpoint of heat resistance of the other component members disposed on the substrate 1 such as wirings or electrodes. Particularly, the substrate 1 is limited to one having a particularly high heat resistance, such as quartz glass or a ceramic substrate. Considering the application to a display panel or the like having a large area, the substrate 1 may result in an extremely expensive product.

Therefore, according to the present invention, as a method of performing a more preferable "resistance reducing process", the polymer film is irradiated with condensed light (focused light) in a wavelength range, for instance from infrared radiation to ultraviolet radiation, such as xenon light, argon light or laser beam, by using a means for irradiating light. Thus, the temperature of the polymer film is increased and the resistance of the polymer film is also reduced. With this method, it is possible to perform the resistance reducing process on the polymer film without using a specific substrate.

Further, according to the present invention, light irradiation is conducted at a time on a region where a plurality of units (plural polymer films) are arranged, thereby efficiently reducing the resistivity of the polymer films. This enables significant reduction of a time period required for the resistance reducing process. However, in the method described above, light may be irradiated not only to the polymer film and the electrodes arranged in the region irradiated at a time but also to the wirings connected to the electrodes. In this case, a temperature of the wirings may rise to the temperature of heat resistance limit of the wirings (melting point of wirings) or more. Further, the problems, such as breaking due to melting of wiring or short circuit due to melting of the insulating layer (numeral 8 shown in FIG. 6 to FIG. 10) for insulating between wirings (numeral 7 and 9 shown in FIG. 1, FIG. 5 to FIG. 10), may arise. As a result, defects of pixels may be generated. Accordingly, the present invention solves these problems by taking a condition that the light absorptance of the wirings for the irradiating light is lower as compared with that the electrodes.

Note that, in the case of the irradiation of condensed light, the substrate 1 on which the electrodes 2 and 3 and the polymer film are formed is placed on a stage and then light is irradiated onto the polymer film. At this time, the irradiation of light is generally performed in surroundings that inhibit oxidation (combustion) of the polymer film. Thus, it is preferable to perform the irradiation of light under an inert gas atmosphere or in a vacuum.

When light is irradiated while being scanned sequentially, it is preferable to scan and irradiate the light so that the polymer films constituting the units are made substantially uniform in resistance (resistivity) The resistances of the polymer films can be made substantially uniform, for example, in such a manner that the irradiation time periods of light to the polymer film are controlled to substantially become uniform and amounts of irradiated light are controlled so as to be kept substantially constant within a range of irradiated light spot.

Note that, a case where light is irradiated while being scanned sequentially is explained here. Needless to say, however, the present invention can be also applied to a method of collectively irradiating light to an entire surface of the region on which the units are formed.

While performing light irradiation, the resistance value between the electrodes 2 and 3 is monitored, so that judgement can be made to terminate the light irradiation at the time when a desired resistance value is obtained.

(4) Next, the gap 5 is formed in the electroconductive film 4' obtained in the previous step (3) (the gap 5 is formed in the film 4' obtained by subjecting the polymer film to the "resistance reducing process").

The gap 5 can be formed by applying a voltage between the electrodes 2 and 3 (i.e., by causing a current to flow in the electroconductive film 4'). Through this "voltage application step", the gap 5 is formed in a part of the electroconductive film 4' (film obtained by subjecting the polymer film to resistance reducing process). At this time, the voltage to be applied may be either DC or AC. Also, a pulse voltage such as rectangular pulse may be applied once or plural times as needed.

Note that, the "voltage application step" may be also performed while continuously applying a voltage between the electrodes 2 and 3 concurrently with the above-described "resistance reducing process". Further, in order to form the gap 5 with good reproducibility, gradually increasing the voltage applied to the electrodes 2 and 3 is preferably performed in the "voltage application step". Whatever the case may be, the "voltage application step" is preferably performed under a reduced pressure atmosphere. And more preferably, the "voltage application step" is performed under an atmosphere at a pressure of $1.3\times10^{-3}$ Pa or less. Whatever the case may be, the "voltage application step" is preferably performed under a reduced pressure atmosphere. And more preferably, the "voltage application step" is performed under an atmosphere at a pressure of $1.3\times10^{-3}$ Pa or less.

When the voltage, higher than that applied between the electrodes 2 and 3 at the time of forming the gap 5, is applied to the electroconductive film 4' having the gap 5, a tunnel current flows through the gap 5. At this time, a high voltage (higher than that applied electrodes 2 and 3) is applied to an anode electrode (not shown) disposed opposite to the substrate 1. With the above application, the tunnel current is partially scattered and a part of the scattered tunnel current can reach the anode electrode.

The width of the gap 5 (distance between a leading end (or a tip) of the carbon film 4' connected to the electrode 3, which is oriented toward the electrode 2 side, and a surface of the electrode 2 exposed into the gap 5 (or distance between a surface of the carbon film 4' forming the gap 5 and disposed on the electrode 2)) is preferably 50 nm or smaller, more preferably 10 nm or smaller, further preferably 5 nm or less. In this way, the electron-emitting device of the present invention can be driven at several tens of V.

Figure 3:
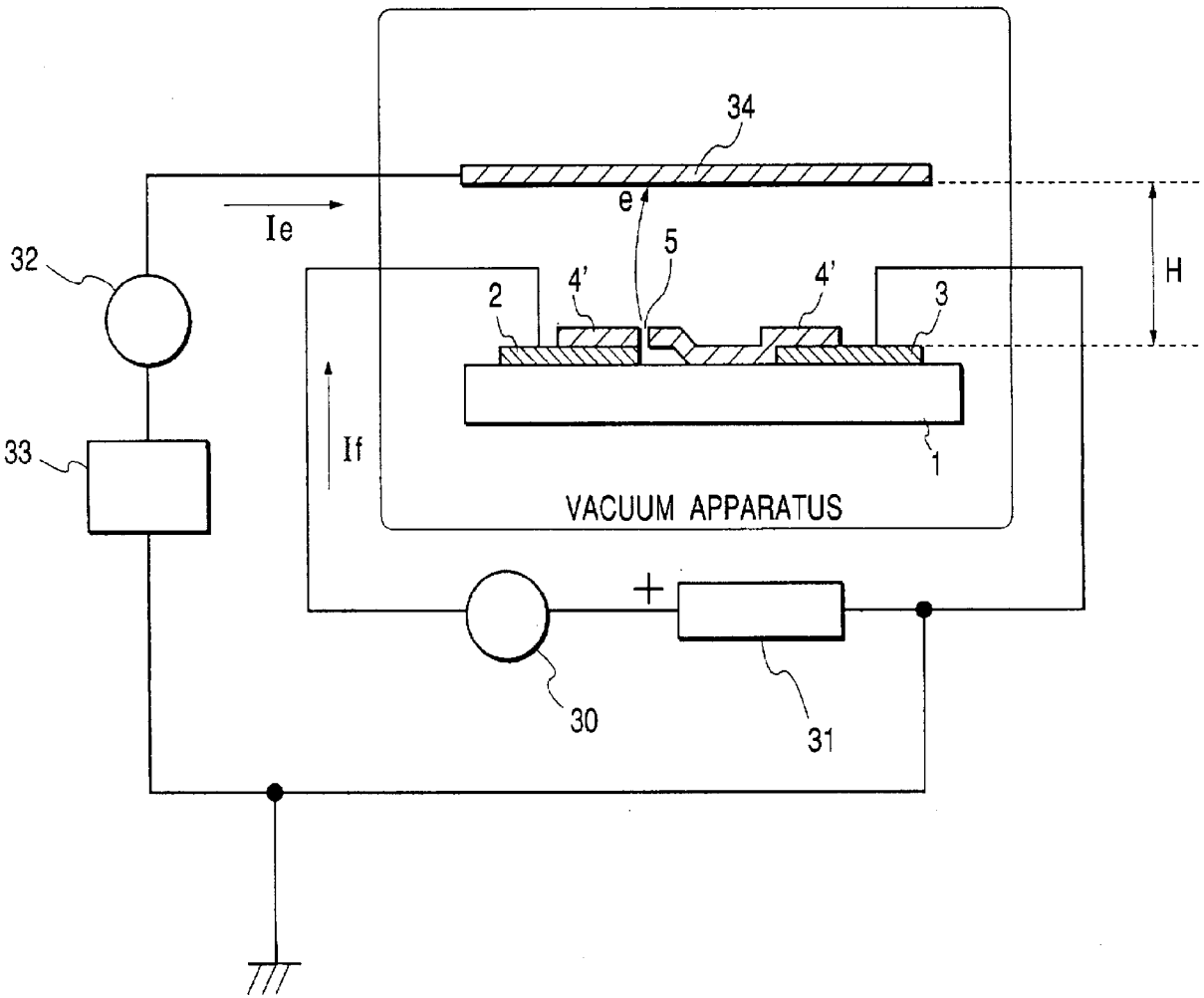
FIG. 3 is a schematic diagram illustrating an example of a vacuum apparatus equipped with a measurement-evaluation mechanism.
Figure 11:
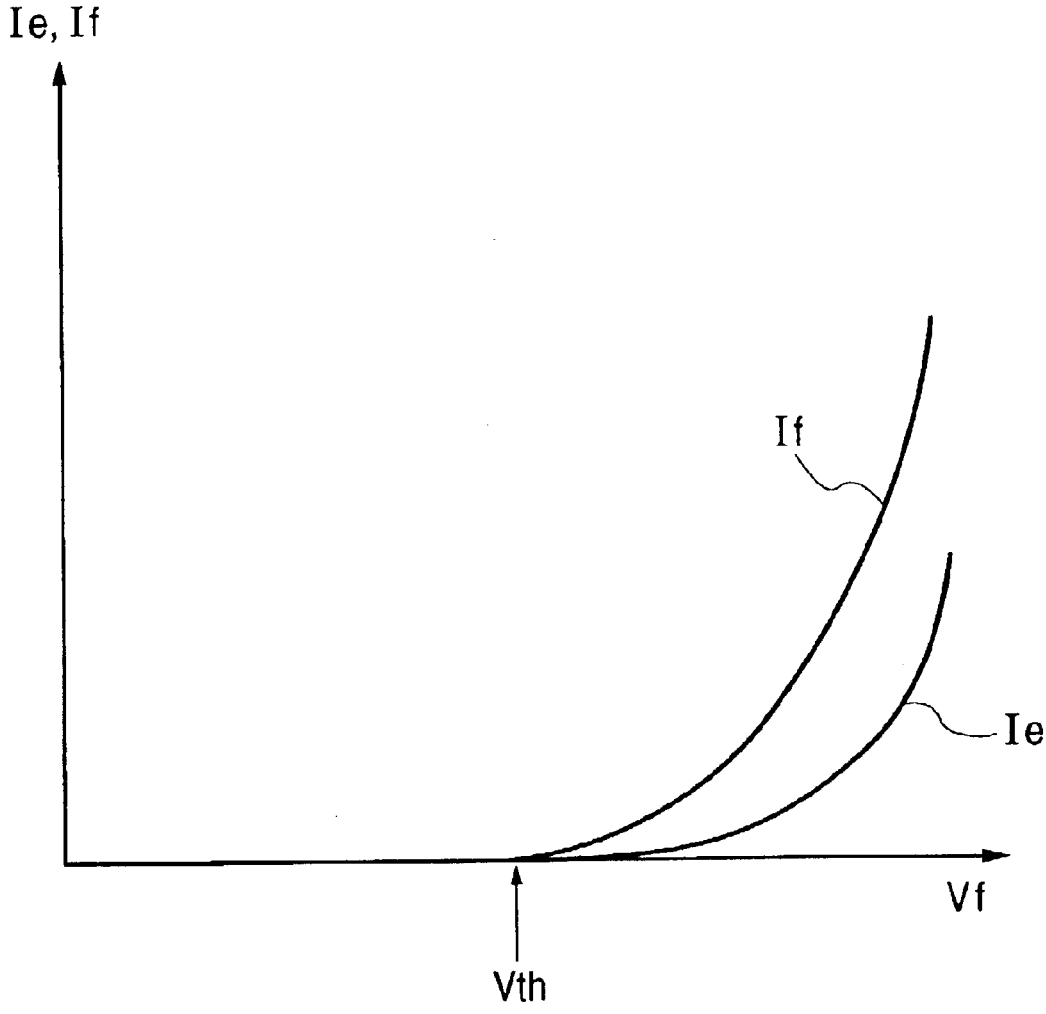
FIG. 11 is a schematic diagram illustrating an example of an electric conduction characteristic distribution of an electron source according to the present invention.

The electron source of the present invention obtained through the steps described above is subjected to the measurement of voltage-current characteristics using a measurement apparatus shown in FIG. 3. The resulting characteristics are shown schematically in FIG. 11. That is, the electron-emitting device of the present invention has a threshold voltage Vth. Therefore, if a voltage which is lower than the threshold voltage Vth is applied between the electrodes 2 and 3, there is substantially no emission of electrons. However, if a voltage which is higher than the threshold voltage Vth is applied, an emission current (Ie) from the device and a device current (If) flowing between the electrodes 2 and 3 begin to increase.

Since the electron-emitting device of the present invention has the above characteristics, a plurality of the electron-emitting devices can be disposed in matrix on the same substrate to form an electron source. Therefore, it becomes possible to perform a simple matrix drive by selecting the desired device and driving the selected device.

FIG. 3 shows a basic structure for driving the electron source. Note that, in FIG. 3, the same reference numerals as those used, for example, in FIGS. 2A and 2B denote the same structural components as those of FIG. 3, respectively. Reference numeral 34 denotes an anode, 33 denotes a high-voltage power supply, 32 denotes an ampere meter for measuring an emission current Ie emitted from the electron source, 31 denotes a power supply for applying a drive voltage Vf to the electron source, and 30 denotes an ampere meter for measuring a device current If flowing between the electrodes 2 and 3. For measuring the current If and the emission current Ie of the electron source, the power supply 31 and the ampere meter 30 are connected to the electrodes 2 and 3, and the anode electrode 34 connected to the power supply 33 and the ampere meter 32 is arranged above the electron source. Also, this electron source and the anode electrode 34 are placed inside the vacuum apparatus that is equipped with devices necessary for the vacuum apparatus, such as a vacuum pump and a vacuum gauge (not shown), so that the measurement and evaluation can be performed on this electron source in a desired vacuum condition. Note that, a distance H between the anode electrode and the electron source is set to 4 mm and the pressure in the vacuum apparatus is set to $1\times10^{-6}$ Pa.

Next, an example of a manufacturing method for the image-forming apparatus using the above electron source shown in FIG. 1 in accordance with the present invention will be described below with reference to, for example, FIGS. 4 to 12B.

(A) At first, a rear plate (substrate) 1 is prepared. The rear plate 1 made of an insulating material may be used and particularly, it is preferably made of glass.

Figure 4:
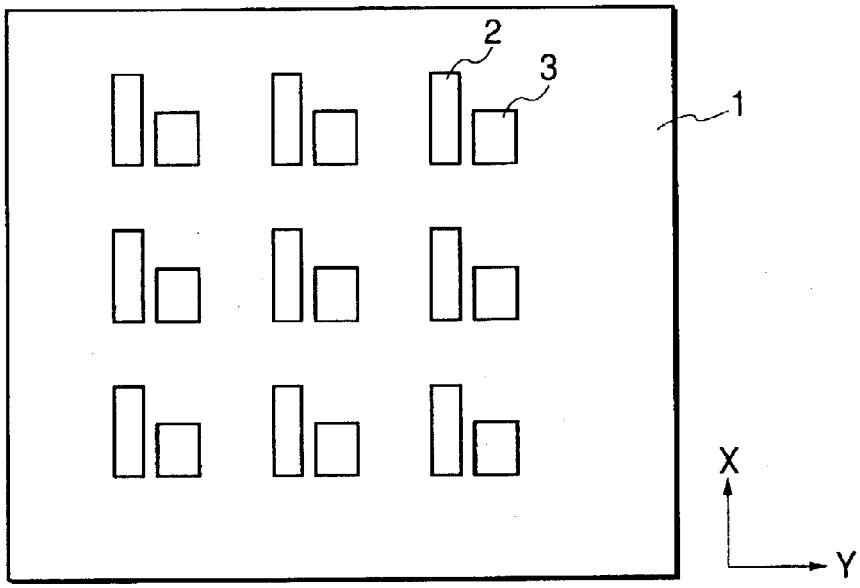
FIG. 4 is a schematic diagram illustrating an example of a method of manufacturing an electron source according to the present invention.

(B) Next, a plurality of pairs of electrodes 2 and 3 shown in FIG. 1 are prepared and formed on the rear plate 1 (FIG. 4). In addition, a method of forming the electrodes 2 and 3 may be one of various kinds of manufacturing methods such as a sputtering method, a CVD method, and a printing method. Note that, in FIG. 4, for simplifying the explanation, there is shown an example in which nine pairs of electrodes in total, i.e., three pairs of electrodes in the X direction and three pairs of electrodes in the Y direction, are formed. However, the number of the pairs of electrodes is appropriately defined depending on the resolution of the image-forming apparatus.

Figure 5:
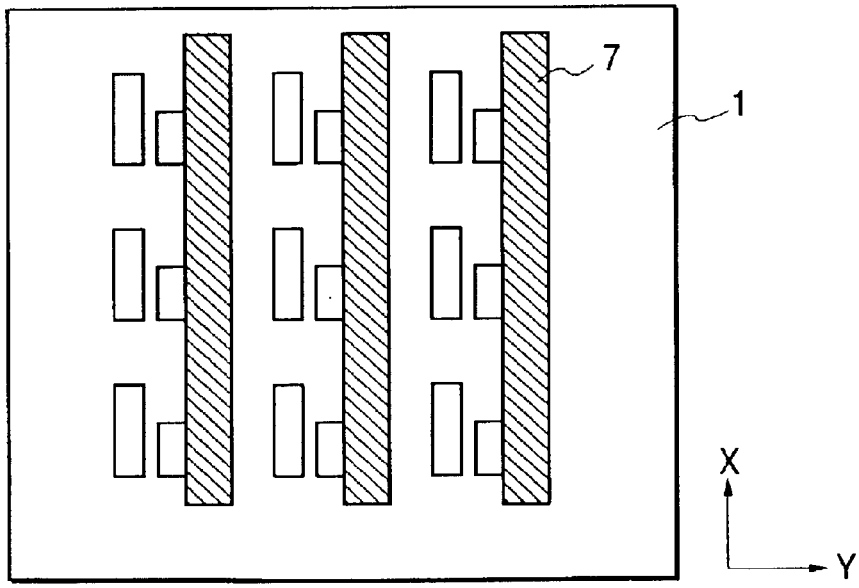
FIG. 5 is a schematic diagram illustrating an example of a method of manufacturing an electron source according to the present invention.

(C) Next, lower wirings 7 are formed such that a part of the electrode 3 is covered with the lower wiring 7 (FIG. 5).

As a material for the lower wirings 7, used is a material having an absorptance with respect to the irradiated light during the subsequent resistance reducing process of a polymer film 4, which is lower than that of the electrodes 2 and 3, preferably lower by 15% or more. With this, light is efficiently reflected to suppress temperature rise of the wirings. A material having a light absorptance of 20% or less (the light reflectance of 80% or more) is more preferably used although varying depending on the wavelength of used light. Also, for efficiently releasing heat, a material having high thermal conductivity is further preferable.

When visible radiation is used, a metallic material such as Ag, Cu, or Al can be used as a material satisfying such conditions. Also when infrared radiation is used, a metallic material such as Ag, Au, or Cu can be used. Further, a transparent metal oxide material such as ITO may be also used.

The method of forming the lower wiring 7 may be one selected from various kinds of methods. In order to prevent diffuse reflection of light, a smooth surface is preferable. To achieve the smooth surface, a sputtering method, a vacuum deposition method, a CVD method, or the like is preferably used. In some cases, a printing method is used for the substrate having a large area because it has an advantage in that the lower wirings 7 can be formed thereon at low cost.

Also, for example, coating may be performed on base layer of the lower wirings 7 by an electroplating method or the like. In this case, a material for the wirings as a base and that used for coating may be different. That is, the wirings comprises a base layer which satisfies electroconductivity and coating layer while satisfies low light absorption or high reflectivity. Through coating, the light absorptance of the wirings can be lowered as compared with the electrodes. Also, coating also makes the surface smooth, so that when the wirings are formed by the printing method and then subjected to coating, the wirings having the smooth surface can be formed at low cost. Thus, coating is preferably used.

Figure 6:
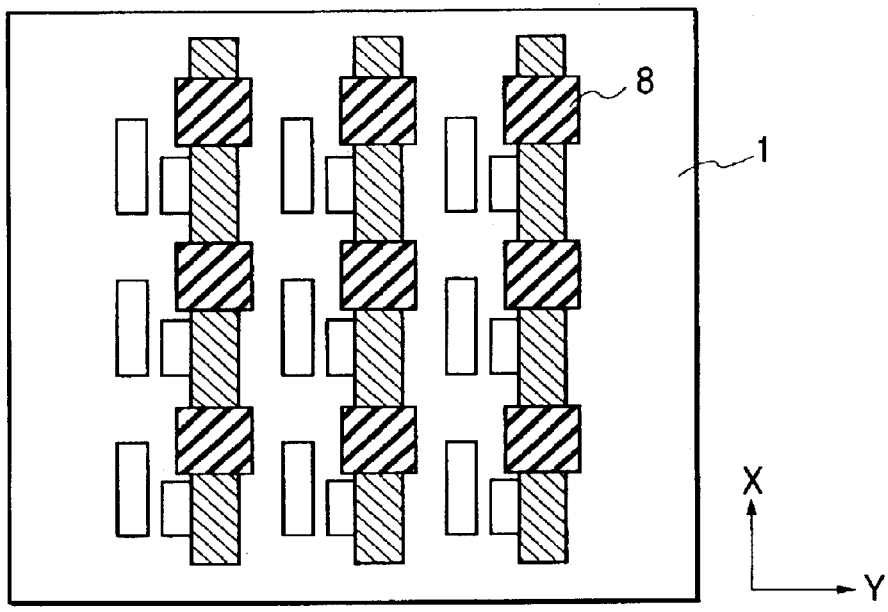
FIG. 6 is a schematic diagram illustrating an example of a method of manufacturing an electron source according to the present invention.

(D) An insulating layer 8 is formed on an intersecting portion of the lower wiring 7 and an upper wiring 9 formed in the subsequent step (FIG. 6). A method of forming the insulating layer 8 may be also one selected from various kinds of methods. In order to form the upper wirings 9 described below with a smooth surface, the insulating layer 8 is preferably formed so as to obtain a smooth surface. To achieve the smooth surface, a sputtering method, a vacuum evaporation method, a CVD method, or the like is preferably used. In some cases, a printing method is used for the substrate having a large area because it has an advantage in that the upper wirings 9 can be formed thereon at low cost.

Figure 7:
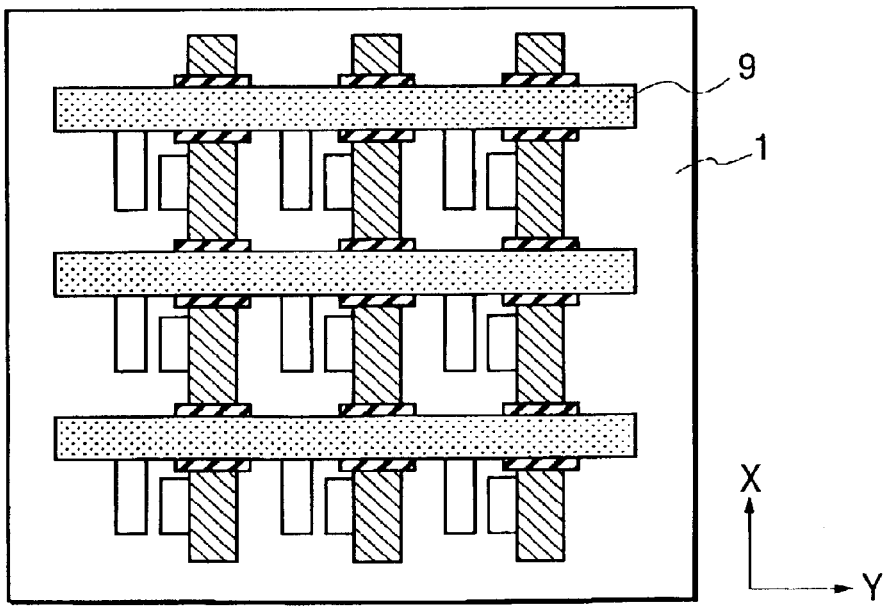
FIG. 7 is a schematic diagram illustrating an example of a method of manufacturing an electron source according to the present invention.

(E) The upper wirings 9 are formed so as to substantially intersect with the lower wirings 7 to be connected with the electrodes 2 (FIG. 7).

As a material for the upper wirings 9, the same material as that for the lower wirings 7 is used for the same reason as in the case of the lower wirings 7. A method of forming the upper wirings 9 can also employ the same method as the lower wirings 7.

Figure 8:
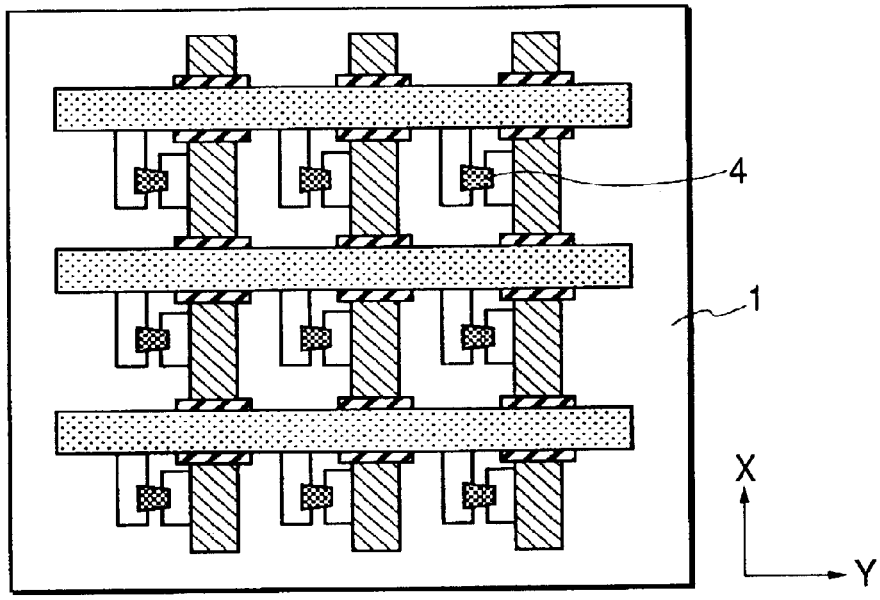
FIG. 8 is a schematic diagram illustrating an example of a method of manufacturing an electron source according to the present invention.

(F) Next, the polymer film 4 is formed so as to make a connection between the electrodes 2 and 3 in each pair (FIG. 8). The polymer film 4 can be prepared by the various methods as described above. It is also possible to employ a photolithography technique for patterning to form the polymer film 4 into a desired shape. For easily forming such a polymer film 4 on a large surface area of the substrate, the ink jet method can be also used. As for the shape of the polymer film 4, as shown in, for example, FIG. 8, a boundary portion (boundary length) where one electrode is connected to the polymer film is preferably made longer than a boundary portion (boundary length) where the other electrode is connected to the polymer film. With such a shape, a position at which the gap 5 is formed is defined in the vicinity of one of the electrodes under control. A method of controlling the gap to be formed in the vicinity of one of the electrodes is not exclusively used for a case of trapezoid shape as shown in, for example, FIG. 8. As long as the formation of the gap 5 by using Joule heat generated in the "voltage application step" described below is controlled to define its position in the vicinity of one of the electrodes, the polymer film and/or the electrodes may be of any shape.

Figure 9:
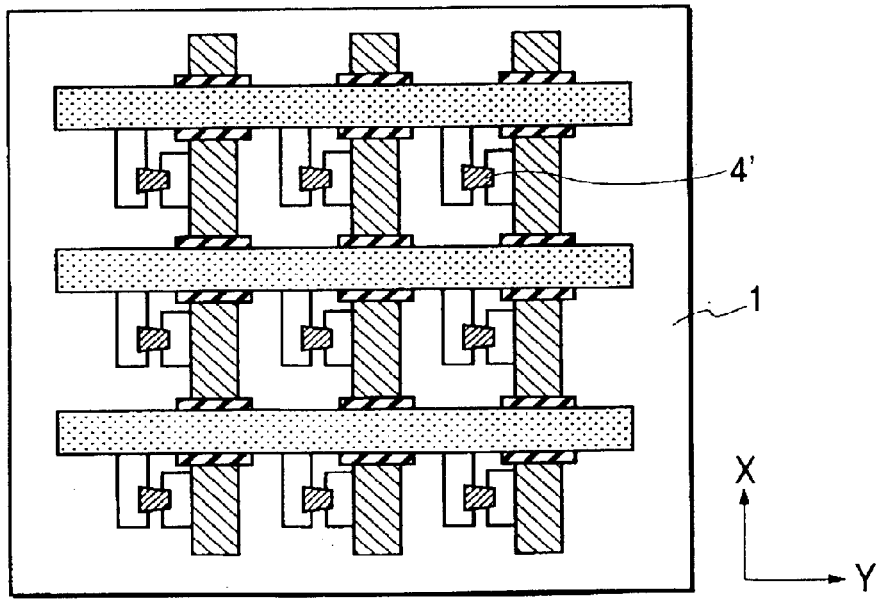
FIG. 9 is a schematic diagram illustrating an example of a method of manufacturing an electron source according to the present invention.

(G) Subsequently, as described above, each polymer film 4 is subjected to the "resistance reducing process" (or "resistance decreasing process") to reduce (or decrease) the resistivity of the polymer film 4 (FIG. 9). The "resistance reducing process" is performed by the irradiation of light, such as the above-mentioned xenon light or argon light or laser beam. The "resistance reducing process" is preferably performed in a reduced pressure atmosphere.

This step allows the polymer film 4 to have conductivity, so that the polymer film 4 is converted into an electroconductive film 4'. Specifically, the sheet resistivity value of the electroconductive film 4' is in the range between $10^3$ Ω/□ or more and $10^7$ Ω/□ or less.

(H) Next, the gap 5 is formed in the electroconductive film 4' (film obtained by subjecting the polymer film 4 to resistance reduction) obtained in the step (G).

Figure 10:
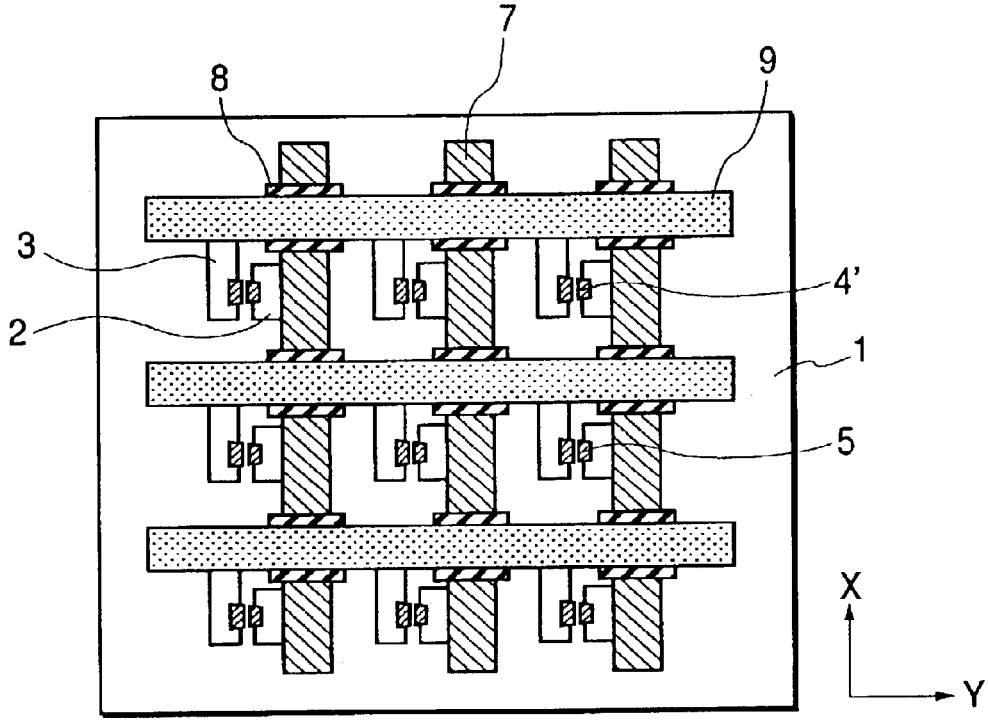
FIG. 10 is a schematic diagram illustrating an example of a method of manufacturing an electron source according to the present invention.

The formation of the gap 5 can be attained by applying a voltage to each of the wirings 7 and 9. Thus, the voltage is applied between the electrodes 2 and 3 of each pair to flow an electric current through the electroconductive film 4' obtained by the resistance reducing process. Furthermore, the voltage to be applied is preferably a pulse voltage. This "voltage application step" forms the gap 5 in a part of the electroconductive film 4' (film obtained by subjecting the polymer film 4 to resistance reduction) (FIG. 10).

The "voltage application step" may be also performed concurrently with the above "resistance reducing process". That is, voltage pulses are successively applied between the electrodes 2 and 3 while irradiating light. Whatever the case may be, the "voltage application step" may be advantageously performed under a reduced pressure atmosphere.

Figure 12A:
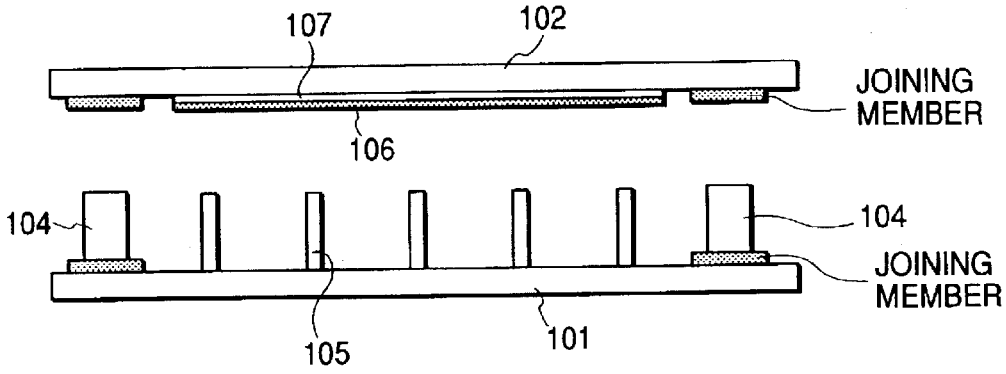
FIGS. 12A and 12B are schematic diagrams illustrating an example of a method of manufacturing an electron source according to the present invention.

(I) Next, a face plate 102 having a phosphor film 107 and a metal back 106 made of an aluminum film, which is prepared in advance, and the rear plate 101 processed in the preceding steps (A) to (H) are aligned such that the metal back 106 faces the electron-emitting device (FIG. 12A). In addition, a joining member is arranged on a contact surface (contact area) between the supporting frame 104 and the face plate 102. Likewise, another joining member is arranged on a contact surface (contact area) between the rear plate 101 and the supporting frame 104. The above joining member to be used is one having the function of retaining vacuum and the function of adherence. Specifically, the joining member may be made of frit glass, indium, indium alloy, or the like.

Figure 12B:
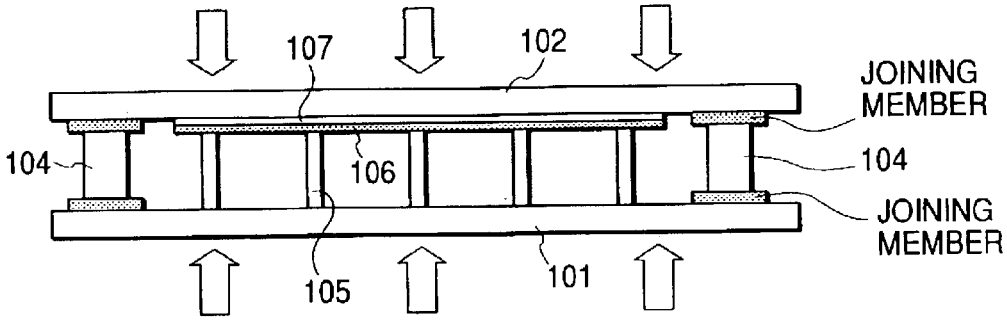

In FIGS. 12A and 12B, there is shown an example in which the supporting frame 104 is fixed (adhered) by means of the joining member on the rear plate 101 preliminarily processed in the preceding steps (A) to (H). According to the present invention, however, there is no need to always bond the supporting frame 104 to the rear plate 101 at the time of performing this step (I). In FIGS. 12A and 12B, similarly, there is also shown an example in which a spacers 105 is fixed on the rear plate 101. According to the present invention, however, there is no need to always fix the spacers 105 on the rear plate 101 at the time of performing this step (I).

Furthermore, in FIGS. 12A and 12B, there is shown an example in which the rear plate 101 is arranged on the lower side, while the face plate 102 is arranged on the upper side of the rear plate 101 for the sake of convenience. According to the present invention, however, it is not limited to such an arrangement. There is no problem as to which one is on the upper side.

Furthermore, in FIGS. 12A and 12B, there is shown an example in which the supporting frame 104 and the spacer 105 are previously fixed (adhered) on the rear plate 101. According to the present invention, however, it is not limited to such a configuration. They may only be mounted on the rear plate 101 or the face plate 102, such that they will be fixed (adhered) in the subsequent "seal-bonding step".

(J) Next, the seal-bonding step is performed. The face plate 102 and the rear plate 101 which have been arranged to face each other in the above step (I), are pressurized in the direction in which they are facing each other, while at least the joining member is heated (FIG. 12B). It is preferable to heat the whole surface of the face plate 102 or the rear plate 101 for decreasing the thermal distortion.

In the present invention, furthermore, the above "seal-bonding step" may be preferably performed in a reduced pressure (vacuum) atmosphere or in a non-oxidative atmosphere. Specifically, the reduced pressure (vacuum) atmosphere may be at a pressure of $10^{-5}$ Pa or less, preferably at a pressure of $10^{-6}$ Pa or less.

This seal-bonding step allows the contact portion between the face plate 102 and the supporting frame 104 and the contact portion between the supporting plate 104 and the rear plate 101 to be airtight. Simultaneously, an airtight container (an image-forming apparatus) shown in FIG. 1 and having the inside kept in a high vacuum can be obtained.

Here, the above example is the "seal-bonding step" performed in a reduced pressure (vacuum) atmosphere or in a non-oxidative atmosphere. According to the present invention, however, the above "seal-bonding step" may be performed in the air. In this case, an exhaust tube for exhausting air from a space between the face plate 102 and the rear plate 101 may be additionally formed in the airtight container. After the "seal-bonding step", air is exhausted from the inside of the airtight container so as to become a pressure of $10^{-5}$ Pa or less. Subsequently, the exhaust tube is closed to obtain the airtight container (the image-forming apparatus) with the inside thereof being kept in a high vacuum.

If the above "seal-bonding step" is performed in a vacuum, for keeping the inside of the image-forming apparatus (the airtight container) in a high vacuum, it is preferable to include a step of covering the metal back 106 (the surface of the metal back 106 facing to the rear plate 101) with a getter material between the above step (I) and step (J). At this time, the getter material to be used is preferably an evaporating getter because it simplifies the covering step. Therefore, it is preferable to use barium as a getter film and to cover the metal back 106 with the getter film. Furthermore, the step of covering with the getter is performed under a reduced pressure (vacuum) atmosphere just as in the case of the above step (J).

Also, in the example of the image-forming apparatus described above, the spacer 105 is arranged between the face plate 102 and the rear plate 101. However, if the size of the image-forming apparatus is small, the spacer 105 is not necessarily required. In addition, if the interval between the rear plate 101 and the face plate 102 is about several hundreds of μm, there is no need to use the supporting frame 104. It is also possible to directly join the rear plate 101 and face plate 102 with the joining member. In such a case, the joining member also supports as an alternative material of the supporting frame 104.

In the present invention, furthermore, after the step (step (H)) of forming the gap 5 of the electron-emitting devices, the positioning step (step (I)) and the seal-bonding step (step (J)) are performed. However, the step (H) may also be performed after the seal-bonding step (step (J)).

Embodiments

Hereinafter, the present invention will be described in more detail below by means of embodiments thereof.

Embodiment 1

In this embodiment, an electron source structured by arranging electron-emitting devices according to the present invention in matrix and an image display apparatus are manufactured.

Hereinafter, this embodiment will be described with reference to FIGS. 4 to 14.

A platinum (Pt) film of 100 nm in thickness was deposited on a glass base plate (substrate 1) by a sputtering method and a plurality of pairs of electrodes 2 and 3 made of the Pt film were formed using a photolithography technique (FIG. 4). Here, the distance between the electrodes 2 and 3 was 10 $\mu$m.

Next, a lower wiring 7 that is an X-directional wiring connected to each of the plurality of electrodes 3 is formed (FIG. 5). Here, a silver (Ag) paste was printed on the substrate 1 by a screen printing method and was then baked by the application of heat to form the lower wiring 7 made of Ag.

Subsequently, an insulating layer 8 was formed at a position as an intersecting portion between the lower wiring 7 and an upper wiring 9 that is a Y-directional wiring by a screen printing method (FIG. 6). The insulating layer is formed of a silicon oxide film.

Then, the upper wiring 9 that is the Y-directional wiring connected to each of the plurality of electrodes 2 is formed to form matrix wirings on the substrate 1 (FIG. 7). Here, similarly to the lower wiring 7, the Ag paste was printed on the substrate 1 by a screen printing method and was then baked by the application of heat to form the upper wiring 9 made of Ag.

A polymer film 4 having a trapezoid shape which is formed of a polyimide film is formed on the position that extends over the electrodes 2 and 3 on the substrate 1 formed with the matrix wirings as described above (FIG. 8).

As shown in FIGS. 2A and 2B, the polymer film 4 is formed such that the connection length of the electrode 2 and the polymer film 4 (or a film 4' obtained by subjecting a polymer film to resistance reducing process) and the connection length of the electrode 3 and the polymer film 4 (or the film 4' obtained by subjecting a polymer film to resistance reducing process) differ from each other depending on the shape of the polymer film 4 (or the film 4' obtained by subjecting a polymer film to resistance reducing process), specifically, such that the connection length of the polymer film and the electrode 2 (≈W1) and the connection length of the polymer film and the electrode 3 (≈W2) differ from each other.

Specifically, a solution of polyamic acid (manufactured by Hitachi Chemical Co., Ltd.: PIX-L110) that is an aromatic polyimide precursor which is diluted with an N-methylpyrrolidone solvent dissolved with 3% triethanolamine was applied over the entire surface of the substrate 1 formed with the matrix wirings by means of a spin coater, and the resultant substrate 1 was baked while a temperature rises up to 350° C. in a vacuum condition to be made into an imide form. Thereafter, application of photoresist is conducted, and steps of exposure (not shown in the figure), developing, and etching are performed, whereby the polyimide film is patterned into a trapezoid shape so as to extend over the device electrodes 2 and 3 to form the polymer film 4 with a trapezoid shape. At this time, the thickness of the polyimide film was 30 nm.

Figure 13:
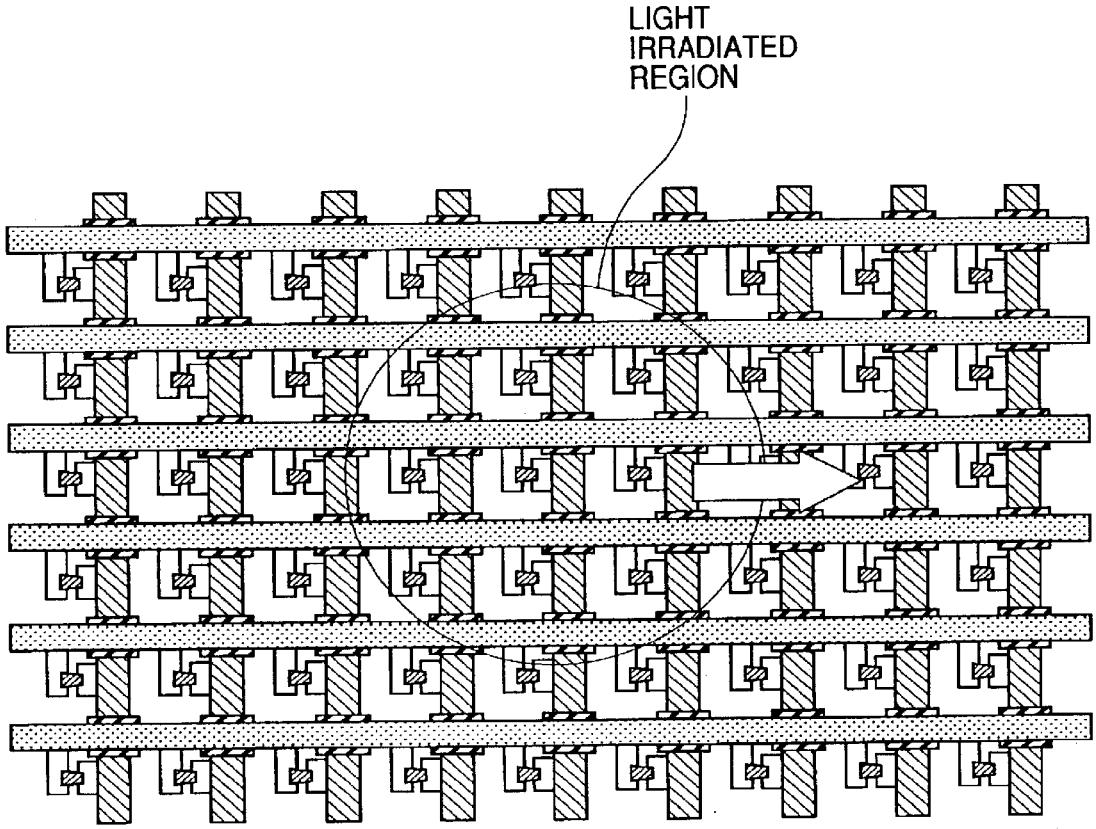
FIG. 13 is a schematic diagram illustrating an example of a method of manufacturing an electron source according to the present invention.
Figure 14:
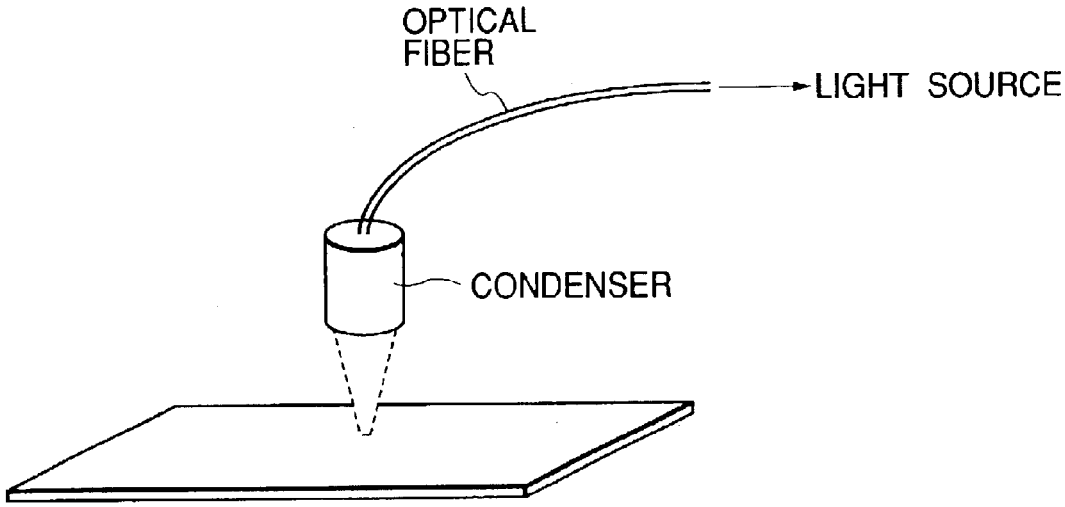
FIG. 14 is a schematic diagram illustrating an example of a method of manufacturing an electron source according to the present invention.

The substrate 1, which is formed with the electrodes 2 and 3 made of Pt, the matrix wirings 7 and 9, and the polymer film 4 comprised of the polyimide film was placed on a stage, and is subjected to xenon light irradiation to perform a resistance reducing process. As to the xenon light, the light emitted from a xenon lamp light source is condensed at a leading end of an optical fiber by an mirror, is guided onto the substrate 1 by the optical fiber, and is further converged at the other end of the optical fiber by using a condenser (FIG. 14). The light irradiation diameter on the substrate 1 was 3 mmØ and the power was 40 W. That is, the plurality of polymer films 4 are included within a region defined by the light irradiation diameter, and the electrodes and wirings connected to the films are subjected to light irradiation simultaneously with the films (FIG. 13). Because, the plurality of polymer films, associated electrodes and part of wirings are arranged in the light irradiated region of the substrate.

The spectrum of the xenon light includes wavelength components in a range of near infrared radiation to visible radiation, and the wavelength component of the near infrared radiation is particularly dominant. On the contrary, Pt has a light reflectance of 70% or less and a light absorptance of about 25%, and the absorbed light is turned into heat. Moreover, a thermal conductivity of Pt is 72 W/mK that is relatively low under the comparison among metals.

On the other hand, the light absorptance of Ag used for wirings with respect to near infrared radiation is 15% or less (the light reflectance is about 85%), and most of the incident light is reflected. Ag has a high thermal conductivity of 430 W/mK. Thus, the heat generated due to the slightly absorbed light was efficiently radiated to the portion other than the light irradiated portion, and Ag was not melted. That is, it is considered that a temperature did not rise to 961° C. or more as a melting point of Ag.

The temperature at the electrodes 2 and 3 rises due to the xenon light irradiation, and further, the temperature at an interval L sandwiched between the electrodes 2 and 3 rises due to thermal conduction. Along with this, the polymer film 4 is heated. Thus, the polymer film 4 comprised of the polyimide film was transformed into a carbon film containing a graphite component (FIG. 9).

Under the above light irradiation condition, resistivity was reduced(decreased) to reach a desired resistivity value for several seconds. Typically, the resistance value was about 1 kΩ with the polymer film having a thickness of 20 nm and a width of 50 $\mu$m.

A light irradiation mechanism was moved parallel with the substrate while being kept with a distance from the substrate, whereby the adjacent polymer films are sequentially subjected to light irradiation with scanning (FIG. 13).

A substrate (electron source substrate) 101 provided with a plurality of device-precursory units in matrix and wirings as described above and a face plate 102 were faced to each other and arranged through a supporting frame 104 with a thickness of 2 mm, and seal bonding was performed thereto at 400° C. using frit glass (FIGS. 12A and 12B). Note that a phosphor film 106 that is a light emitting member and a metal film (metal back 106) made of Al and corresponding to an anode electrode were arranged on the opposing surface of the face plate 102 with respect to the electron source substrate 101. As the phosphor film 106, there was used one in which phosphors respectively emitting three primary colors of R (red), G (green), and B (blue) were arranged in stripe.

An airtight container constituted by the manufactured substrate 101, the face plate 102, and the supporting frame 104 was exhausted through an exhaust tube (not shown) by using a vacuum pump. Further, in order to maintain a degree of vacuum, a non-evaporating getter (not shown) was subjected to heating operation (activation operation of the getter) in the airtight container. Then, the container was sealed by welding the exhaust tube by means of a gas burner.

Lastly, a voltage application step was performed by applying bipolar rectangular pulses with a pulse height of 25 V, a pulse width of 1 msec, and a pulse interval of 10 msec between the respective device-precursory units, namely, the electrodes 2 and 3 through the X-directional wiring 7 and the Y-directional wiring 9 (FIG. 10). Through the step, a gap 5 is formed in the carbon film 4' in the vicinity of the electrode 2 to complete the electron-emitting devices. Thus, the electron source and the image display apparatus in this embodiment were manufactured.

In the image display apparatus completed as described above, a desired electron-emitting device was selected to be applied with a voltage of 22 V through the X-directional wiring 7 and the Y-directional wiring 9, and the metal back 106 was applied with a voltage of 8 kV through a high voltage terminal Hv. As a result, a uniform and satisfactory image could be displayed with no defective pixel.

Embodiment 2

In this embodiment, an electron source structured by arranging electron-emitting devices according to the present invention in matrix and an image display apparatus are manufactured.

In this embodiment, a wiring formation process differs from that in Embodiment 1, but other processes are common with Embodiment 1. Thus, description will be made only of the wiring formation process with reference to FIG. 15.

Figure 15A:
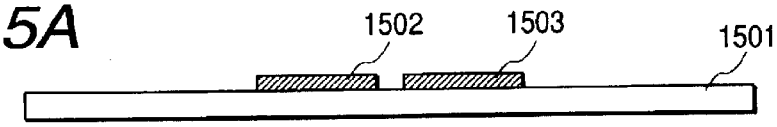
FIGS. 15A, 15B, 15C, 15D, 15E and 15F are schematic diagrams illustrating another example of a method of manufacturing an electron source according to the present invention.

A platinum (Pt) film of 100 nm in thickness was deposited on a glass substrate 1501 by a sputtering method and a plurality of pairs of electrodes 1502 and 1503 made of the Pt film were formed using a photolithography technique (FIG. 15A). Here, the distance between the electrodes 1502 and 1503 was 10 $\mu$m.

Figure 15B:
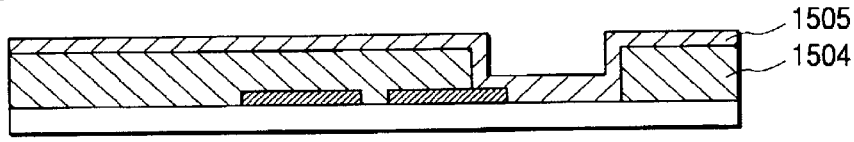

Next, a positive-type photoresist 1504 is applied to the substrate, followed by exposure with the use of a photo mask pictured with patterns of X-directional wirings connected to the electrodes 1503, and further developing. Further, a Pt film 1505 of 50 nm in thickness was formed as a base layer of Y-directional wiring by using a sputtering method (FIG. 15B).

Figure 15C:
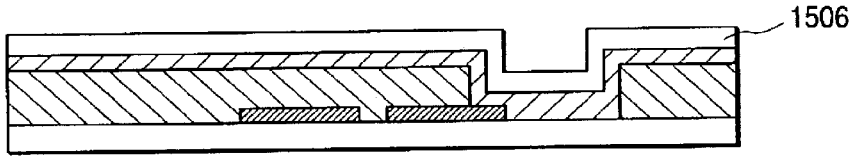

Subsequently, Ag plating 1506 of 200 nm in thickness was formed as a coating layer of Y-directional wiring on the Pt film 1505 by using an electroplating method (FIG. 15C).

Figure 15D:
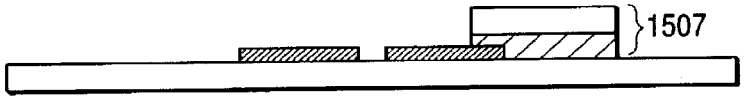

Next, a lower wiring 1507 was obtained by lift-off (FIG. 15D). The lower wiring 1507 has a structure in which Ag is mirror-coated on Pt, suppresses diffuse reflection in light irradiation, and can provide a high light reflectance.

Figure 15E:
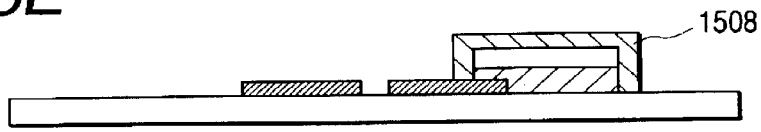

Subsequently, an insulating layer 1508 was formed at a position as an intersecting position between the lower wiring 1507 that is the X-directional wiring and an upper wiring 1511 that is a Y-directional wiring (FIG. 15E). Here, the insulating layer 1508 is formed of a silicon oxide film by using a general photolithography technique.

Next, the positive-type photoresist is applied to the substrate, followed by exposure with the use of a photo mask pictured with patterns of Y-directional wirings connected to the electrodes 1502, and further, developing. Further, a Pt film 1509 of 50 nm in thickness was formed as a base layer of Y-directional wiring by using a sputtering method.

Figure 15F:
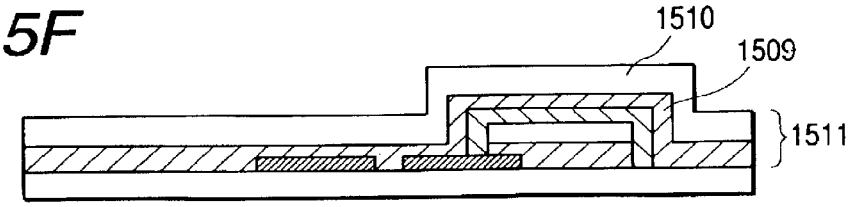

Then, Ag plating 1510 of 200 nm in thickness was formed as a coating layer of Y-directional wiring on the Pt film 1509 by using an electroplating method. Thereafter, the Pt film 1509 and Ag film 1510 on the photoresist are removed together with the photoresist by lift-off to obtain the upper wiring 1511 (FIG. 15F).

The upper wiring 1511 has a structure in which Ag is mirror-coated on Pt, suppresses diffuse reflection in light irradiation, and can provide a high light reflectance of 95% or more.

A polymer film 4 comprised of a polyimide film was formed on the position that extends over the electrodes 1502 and 1503 on the substrate 1501 formed with the matrix wirings as described above.

The light absorptance of Ag with respect to near infrared radiation on the wiring surface was 5% or less (the light reflectance was 95% or more), and most of the incident light was reflected. Thus, Ag was not melted in the "resistance reducing step" of the polymer film.

Embodiment 3

In this embodiment, an electron source structured by arranging electron-emitting devices according to the present invention in matrix and an image display apparatus are manufactured.

In this embodiment, a wiring formation process differs from that in Embodiment 1 or Embodiment 2, but other processes are common with Embodiments 1 and 2.

A platinum (Pt) film of 100 nm in thickness was deposited on a glass base plate (substrate 1) by a sputtering method and a plurality of pairs of electrodes 2 and 3 made of the Pt film were formed using a photolithography technique (FIG. 4). Here, the distance between the electrodes 2 and 3 was 10 $\mu$m.

Next, a silver (Ag) paste was printed on the substrate 1 by a screen printing method and was then baked by the application of heat to form a lower wiring 7 as a base layer of Y-directional wiring that is an X-directional wiring connected to each of the plurality of electrodes 3 (FIG. 5).

Subsequently, an insulating paste was printed at a position as an intersecting portion between the lower wiring 7 that is the X-directional wiring and an upper wiring 9 that is a Y-directional wiring by a screen printing method and was then baked to form an insulating layer 8 (FIG. 6).

Then, an Ag paste was printed by a screen printing method and then was baked by the application of heat to form the upper wiring 9 as a base layer of Y-directional wiring that is the Y-directional wiring connected to each of the plurality of electrodes 2. Thus, matrix wirings were formed on the substrate 1 (FIG. 7).

Figure 16:
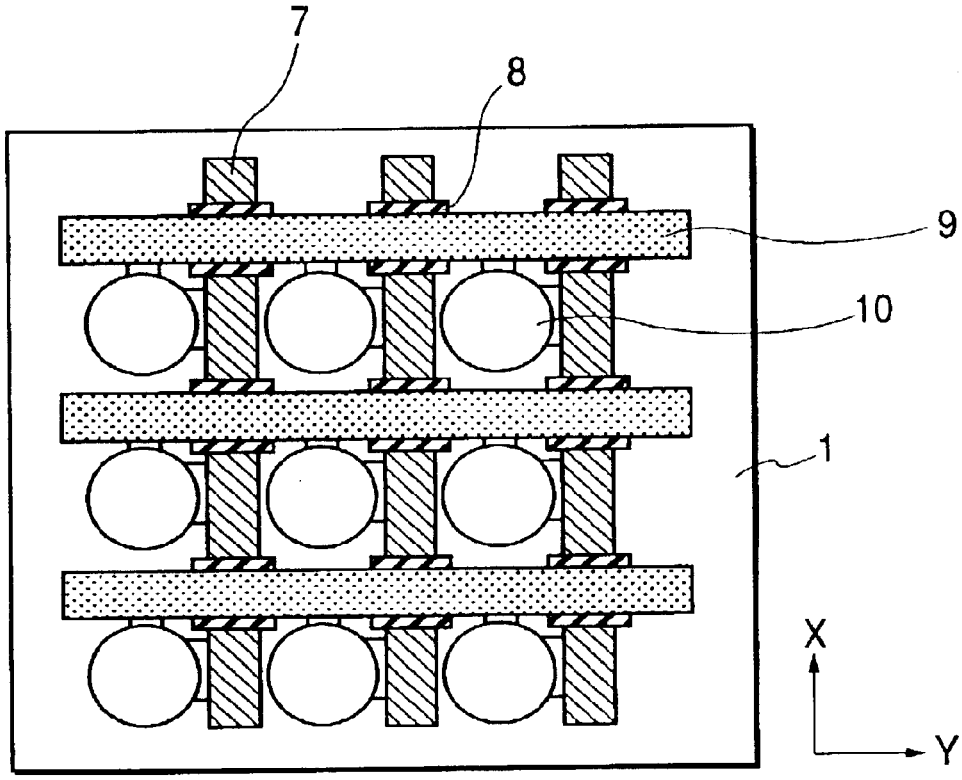
FIG. 16 is a schematic diagram illustrating another example of a method of manufacturing an electron source according to the present invention.
Figure 17A:
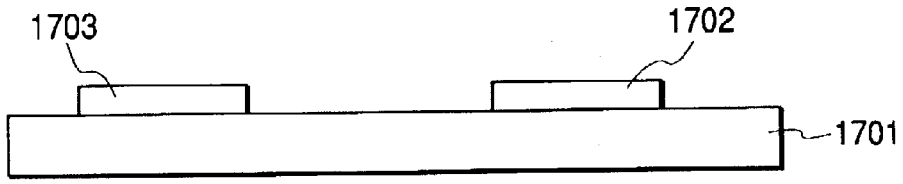
FIG. 17A PRIOR ART
FIGS. 17A, 17B, 17C and 17D are schematic diagrams illustrating an example of a conventional method of manufacturing an electron source.
Figure 17B:
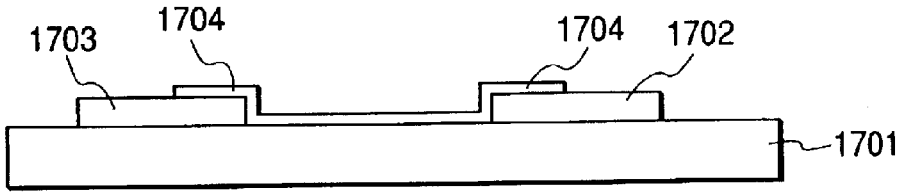
FIG. 17B PRIOR ART
Figure 17C:
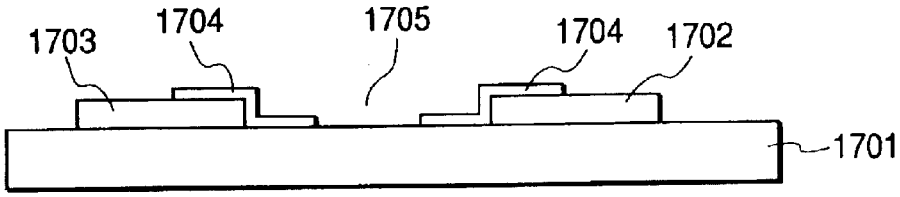
FIG. 17C PRIOR ART
Figure 17D:
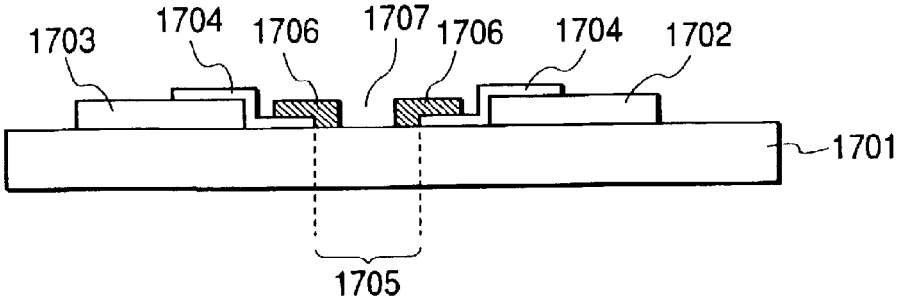
FIG. 17D PRIOR ART
Figure 18A:
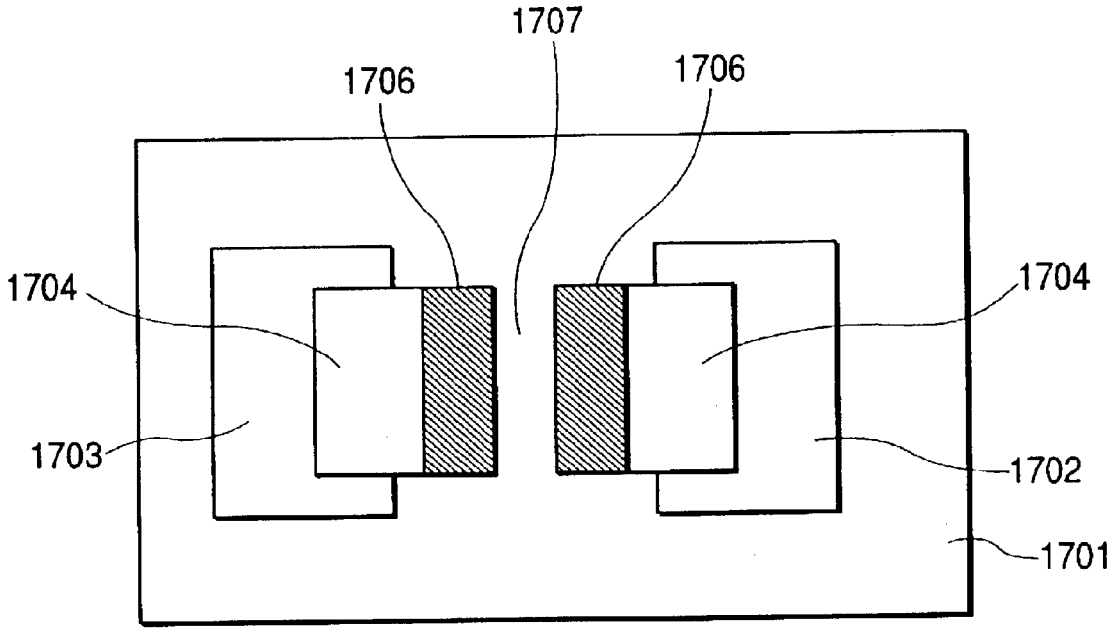
FIG. 18A PRIOR ART
FIGS. 18A and 18B are schematic diagrams illustrating an example of an electron-emitting device constituting a conventional electron source.
Figure 18B:
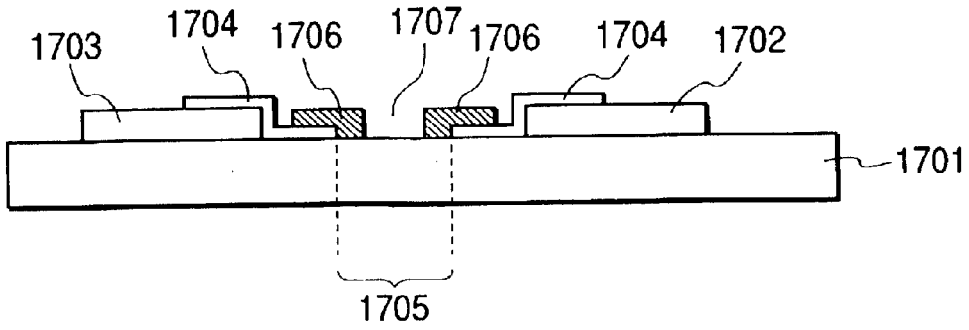
FIG. 18B PRIOR ART

Subsequently, resist 10 was applied to a Pt electrode in the region surrounded by the wirings 7 and 9. The application can employ a method such as photolithography or screen printing. However, an ink jet method was used as a simpler and easier method to apply the photoresist (FIG. 16).

Next, Ag plating of 100 $\mu$m in thickness was deposited as a coating layer of wiring on the wirings 7 and 9 by using an electroplating method, and then, the resist 10 was removed. At this time, the resist 10 serves as a protective layer against the plating, and thus can prevent Ag from attaching to the Pt electrode.

Through the above-described step, the wiring surface became a mirror surface. Thus, improvement in the light reflectance was further attained compared with the wiring surface obtained by the forming method in Embodiment 1.

A polymer film 4 comprised of a polyimide film was formed on the position that extends over the electrodes 2 and 3 on the substrate 1 formed with the matrix wirings as described above (FIG. 8).

The light absorptance of Ag with respect to near infrared radiation on the wiring surface was 5% or less (the light reflectance was 95% or more), and most of the incident light was reflected. Thus, Ag was not melted in the "resistance reducing process" of the polymer film.

According to the present invention, in the light irradiation in the "resistance reducing process" of the polymer film in the formation of the electron source, a temperature rises at the electrode connected to the polymer film due to light absorption, and thus, transforming of the polymer film progresses; on the other hand, the light irradiated to the wiring connected to the electrode is efficiently reflected, the temperature rise in the wiring portion is suppressed, and thus, the wiring damage can be reduced. Consequently, the electron source with no defective part for electron emission can be formed.

Further, transforming becomes possible through batch light irradiation of the region including the electrode. As a result, the electron source can be formed efficiently.

Furthermore, the image display apparatus capable of displaying an image with excellent quality in a large area can be efficiently manufactured by using the electron source formed by the manufacturing method according to the present invention.

What is claimed is:

1. A method of manufacturing an electron source, comprising the steps of:

(A) providing a substrate on which a plurality of units and wirings are arranged, each unit comprising a pair of electrodes and a polymer film for connecting the electrodes of the pair and the wirings respectively being connected to at least one of the plurality of units;

(B) irradiating light onto a region of the substrate where two or more units and part of the wirings are arranged, to reduce resistivity of the polymer film in each of the two or more units;

(C) forming a gap in a film obtained by performing the step (B), wherein for the irradiating light in step (B), a light absorptance of the wirings is lower than that of the electrodes.

2. A method of manufacturing an electron source according to claim 1, wherein the irradiation of light is performed to all the plurality of units with sequential scanning.

3. A method of manufacturing an electron source according to claim 1, wherein the light absorptance of the wirings is lower than a light absorptance of the pair of electrodes by 15% or more.

4. A method of manufacturing an electron source according to claim 1, wherein a light absorptance of the wirings is 20% or lower.

5. A method of manufacturing an electron source according to claim 1, further comprising the step of arranging a coating layer on a base layer of the wirings, for the irradiation light in the step (B), a reflectivity of the coating layer being higher than that of the base layer.

6. A method of manufacturing an electron source according to claim 1, wherein the gap is formed by flowing an electric current through the film obtained by the step (B).

* * * * *

UNITED STATES PATENT AND TRADEMARK OFFICE

CERTIFICATE OF CORRECTION

PATENT NO. : 6,817,915 B2
DATED : November 16, 2004
INVENTOR(S) : Masafumi Kyogaku et al.

It is certified that error appears in the above-identified patent and that said Letters Patent is hereby corrected as shown below:

Column 2,
Line 6, "films" should read -- film's --.

Column 3,
Line 8, "subjected" should read -- subject --.

Column 4,
Line 24, "comprises" should read -- comprise --.

Column 6,
Line 33, "is" should read -- are --; and
Line 51, "process)" should read -- process") --.

Column 7,
Line 51, "(numeral 7" should read -- (numerals 7 --; and
Line 56, "that" should read -- that of --.

Column 8,
Line 41, "Whatever" should be deleted;
Lines 42-45 should be deleted; and
Line 50, "applied" should read -- applied between --.

Column 10,
Line 27, "satisfies" should read -- satisfying --.

Column 14,
Line 15, "an mirror," should read -- a mirror, --.

UNITED STATES PATENT AND TRADEMARK OFFICE

CERTIFICATE OF CORRECTION

PATENT NO. : 6,817,915 B2
DATED : November 16, 2004
INVENTOR(S) : Masafumi Kyogaku et al.

It is certified that error appears in the above-identified patent and that said Letters Patent is hereby corrected as shown below:

Column 18,
Line 7, "units;" should read -- units; and --.

Signed and Sealed this

Sixth Day of September, 2005

JON W. DUDAS
*Director of the United States Patent and Trademark Office*